United States Patent [19]

Seaman

[11] 4,148,347

[45] Apr. 10, 1979

[54] EXPANDABLE SHOPPING BAG

[76] Inventor: Florence Seaman, 1039 Cecile Dr., Port Moody, British Columbia, Canada

[21] Appl. No.: 883,319

[22] Filed: Mar. 3, 1978

[51] Int. Cl.[2] ..... A45C 3/04

[52] U.S. Cl. ..... 150/1.7; 150/33; 190/44; 224/46 R

[58] Field of Search ..... 150/1.7, 11, 12, 33; 190/44; 224/5 Q, 26 R, 46 R, 47

[56] References Cited

U.S. PATENT DOCUMENTS

| | | | |
|---|---|---|---|
| 61,467 | 1/1867 | Rose | 190/44 |
| 2,431,030 | 11/1947 | Edwards | 150/1.7 |
| 2,432,001 | 12/1947 | Fisler | 150/33 X |
| 3,746,066 | 7/1973 | McIntyre | 150/33 |
| 4,010,784 | 3/1977 | Nattrass | 150/1.7 X |

*Primary Examiner*—Donald F. Norton
*Attorney, Agent, or Firm*—Robert D. Farkas

[57] ABSTRACT

An expandable shopping bag utilizes an open mouth pouch, fabricated from a flexible material, having a girth encircling strap removably secured thereto which permits the pouch to be utilized in small and large item receiving capacities. The strap ends are removably affixed to the pouch adjacent the open mouth portion thereof facilitating its use as a shoulder strap, complementing a pair of string-like handles partially contained within opposed passageways shorter than half the perimeter of the marginal edges of the pouch.

8 Claims, 4 Drawing Figures

EXPANDABLE SHOPPING BAG

BACKGROUND OF THE INVENTION

1. The Field of the Invention

This invention relates to expandable pouches and more particularly to that class of pouch or bag which facilitates containing items therein of extremely large size when the pouch is in an expanded condition and permits the pouch to be utilized in a partially folded up condition, at all other times.

2. Description of the Prior Art

The prior art abounds with foldable and collapsible bags and pouches of many varieties. U.S. Pat. Nos. 2,447,940 issued Aug. 24, 1948 to I. Holland and 2,431,030 issued Nov. 18, 1947 to E. L. Edwards each teach a self-closing or foldable handbag wherein a string-like attachment is threadingly engaged with the side walls of the bag adjacent the open mouth regions thereof such that when the string-like attachment is pulled taut the open mouth portion of the bag is shrunk into a closed condition thereby maintaining the contents of the bag locked therewithin, permitting the string-like attachment to act as a handle therefor. Unfortunately, such apparatus is restricted in the size of the articles that may be contained within the bag and is not otherwise foldable so as to permit the bag size to be collapsed when carrying small articles therewithin.

U.S. Pat. Nos. 676,659 issued June 18, 1901 to M. E. Mogg (No. 1) and 676,659 issued the same date to the same inventor, (No. 2) both teach a flexible pouch-like bag having a handle attachment affixed to the sides of the bags and extending upwardly from the open mouth portions thereof. Such handles may not be used when attempting to grasp them together with one hand of the user when a large package is inserted within the container such that a portion of the package extends outwardly from the open mouth region of the bag.

SUMMARY OF THE INVENTION

A primary object of the present invention is to provide a collapsible and expandable shopping bag which may be utilized to carry large or small packages with equal ease.

Another object of the present invention is to provide an expandable shopping bag wherein the otherwise usable small gathering-like handle disposed in the marginal edges thereof, are not required for purposes of carrying the bag when large articles are disposed carried within the bag.

Still another object of the present invention is to provide a girth encircling strap which permits the bag to be utilized in a collapsed or folded up condition whilst carrying articles, serving as a shoulder strap, if desired, when the bag or pouch is permitted to be expanded to full size whilst carrying larger articles.

Yet another object of the present invention is to provide a shopping bag or pouch which may be carried about utilizing hand grasping handles and a shoulder strap carrying means.

A further object of the present invention is to provide a girth encircling strap which may be utilized to secure articles within the bag when such strap is maintained in a tightened condition therearound.

Another object of the present invention is to provide a pouch or bag expansion limiting strap which adds greater strength to the bag when installed wrapped around the girth of such bag.

Still another object of the present invention is to provide a pouch-like shopping bag having a pair of opposed hand grasping handles serving to close the open mouth portion of the pouch when such handles are grasped and utilized to lift the bag upwardly.

Yet another object of the present invention is to provide an expandable shopping bag having a storage location for shoulder straps, when such shoulder straps are not being utilized for the bag carrying operation.

Heretofore, shopping bags were predominantly fabricated having a generalized sack or bag-like shape in which a pair of inverted U-shaped handles were affixed to opposed marginal edges of the bag upstanding from the open mouth regions thereof. However, when it is desired to carry large articles within the bag or pouch, such handles tended to reside on the sides of such articles provided the length of such articles extended outwardly from the open mouth regions of the pouch, thereby preventing efficient carrying about of the pouch with the large package therewithin. Furthermore, large shopping bags represented an inconvenient carrier when carrying about small items within the bag. Hence, it is highly desirable to provide an expandable shopping bag capable of having small storage capacity therewithin when carrying small articles and a larger storage capacity when carrying large articles, coupled with carrying handles or straps which extend well above the top of large items carried about within the bag. Furthermore, when carrying small articles it is highly desirable to maintain the open mouth region of the pouch in a semi-closed condition. In addition, it is desirable to add to the strength of the bag by utilizing a strap portion wrapped about the girth of the bag thereby preventing heavy items from bulging the sides of the bags outwardly tending to rupture them. The present invention recognizes these needs and provides a ready solution therefor by utilizing a girth encircling strap which tends to maintain the bag in a small shape, suitable for carrying about small items therewithin. The strap may be loosened so as to accommodate larger articles of commerce within the bag, as desired. Finally, the strap may be removed from its waist encircling position and be disposed extending upwardly and outwardly from the open mouth portion of the bag so as to form thereby a shoulder strap for carrying the bag, or alternatively, an extended or lengthy hand grasping handle. A pair of short string-like handles are attached to opposed loop-like channels disposed on opposite surfaces adjacent the marginal edges of the pouch occupying a length somewhat less than half the perimeter of the bag. In this position, portions of the exposed string-like attachments act as handles and when so used, tend to pull together, in a semi-gathering type arrangement, the majority of the perimeter of the open mouth portion of the bag, when the handles support the bag. The remaining ungathered portions of the perimeter of the open mouth portion of the bag may be folded inwardly intermediate the gathered portions when the bag is in a semi-folded up condition or extended outwardly when the bag encircling strap is loosened, in a large item carrying mode. When the string-like attachments are relaxed, the bag mouth may be fully opened and the bag may be carried about utilizing the girth encircling straps in a shoulder strap mode or a hand-held carrying strap mode such that items may be carried within the bag absconsed totally within the bag or partially passing through the fully open mouthed portions thereof. It this manner, the bag may be folded up, enlarged, carry small parcels or large, be carried utilizing a short pair of opposed hand-held straps or a single elongated strap in either a hand-held mode or a shoulder carrying mode. Since the bag is flexible, the entire apparatus may be rolled up or folded, occupying a small space when not in use.

These objects as well as other objects of the present invention will become more readily apparent after reading the following decription of the accompanying drawings.

DESCRIPTION OF THE PREFERRED EMBODIMENT

Figure 1:
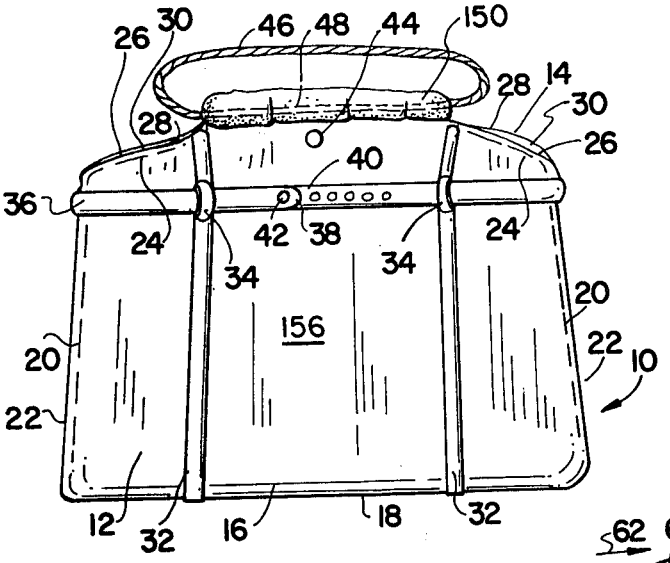
FIG. 1 is a front elevation view of the present invention shown in an expanded mode.

The structure and method of fabrication of the present invention is applicable to a flexible pouch, fabricated from a fabric-like material, such as canvas, having a pair of opposed side walls, sewn together on the lowermost and side marginal edges thereof, a portion of the uppermost marginal edge, of each of the side walls, are turned back on themselves, so as to form a pair of passageways therein, carried within each of the passageways is a string-like attachment, preferably fabricated from a rope-like material, such as leather welting or if desired, cording. A pair of loops are disposed on each of the sheets defining the pouch extending having their open mouth portions disposed about a waist encircling line and located adjacent the open mouth regions of the pouch. A flexible strap, preferably fabricated from leather or the like, is disposed residing within the loops and is provided with a pair of snap fastener components secured on one surface, adjacent the end of such strap, the other surface of the strap is provided having a pair of complementary shaped snap fasteners disposed in spaced apart relationship and secured thereto. Each sheet comprising the bag or pouch is also provided with a complementary snap fasteners disposed adjacent the open mouth portions thereof and intermediate the ends of the passageways. Binding may be disposed adjacent the edges of each of the sheets forming the bag and extending from the open mouth portions of the bag, passing beneath the loops, and downwardly towards the lowermost seam of the pouch. Such binding serves to reinforce the pouch and act decoratively thereon. When the bag is disposed into a folded up condition, the seams extending upwardly from the lowermost bottom seam and the open mouth portion of the bag, may be folded inwardly within the confines of the bag, retained thereat by cinching the girth encircling strap into a tightened position, by having such strap pass through the loops and utilizing one of the snap fastener components into preferred engagement with one of the plurality of complementary snap fastener components. When it is desired to have the bag contain somewhat larger items, the girth encircling strap may be expanded, by allowing the same snap component to engage another complementary snap component, thereby allowing the girth encircling strap to have a greater length. In either position, grasping the string-like attachments, comprising each endless band of flexible string-like material, causes the passageways to gather up tending to seal together the mouth of the pouch in a puckered up condition. When it is desired to utilize the girth encircling strap as a shoulder strap, such strap is removed from the loops, allowing the snap fastener components disposed at the ends thereof to engage the complementary snap fastener components secured to the sides of the bag or pouch. In this location, the shoulder carrying strap extends outwardly from the string attachments which may be either maintained in a taut condition or may be relaxed so as to permit large articles to be placed within the bag extending outwardly from the open mouth region thereof. Obviously, buckles or other fasteners may be substituted for the snap fasteners thereby permitting such bag to carry articles of great weight with relative ease.

Now referring to the figures, and more particularly to the embodiment illustrated in FIG. 1 showing the present invention 10 comprising a sheet 12, superimposed over another sheet 14 therebehind. Dotted lines 16 simulate stitching disposed adjacent lowermost marginal edge 18. Dotted lines 20, disposed on each side of sheet 12 and 14, simulate stitching adjacent marginal edges 22, of sheet 12 and 14. Dotted lines 24 simulate stitching disposed adjacent marginal edges 26 of sheet 12, forming a finished edge thereby. Dotted lines 28 serve the same purpose as dotted lines 24, for sheet 14. Open mouth region 30 is exposed when marginal edges 22 are located outwardly from decorative binding 32. Loops 34 are similar to loops not shown, located similarly on sheet 14. Girth encircling strap 36 is shown carried within loops 34 and has end 38 thereof overlaying region 40, being secured thereto, utilizing snap fastener element 42 therefor. Complementary snap fastener element 44 is shown secured to sheet 12 on external surface 156 thereof. Another complementary fastener, now shown, is located on sheet 14, in an equivalent location to complementary fastener 44. String-like attachment 46 is shown carried within a passageway 150, denoted by dotted lines 48, occupying a position adjacent a portion of the length of marginal edge 26. Passageway 150 is formed by folding such portion of the length of marginal edge 26 over onto external surface 156 of sheet 12 and securing such portion to sheet 12 as by stitching. Another string-like attachment, not shown, extends behind attachment 46 and is carried within another passageway, not shown, similar to that depicted by passageway 150 and is carried adjacent the marginal edge, not shown, of sheet 14. It is to be noted that girth encircling strap 36 extends around the entire external surfaces of sheets 12 and 14, adjacent the uppermost marginal edges of such sheets and is removable from loops 34 and the loops, not shown, carried by sheet 14.

Figure 2:
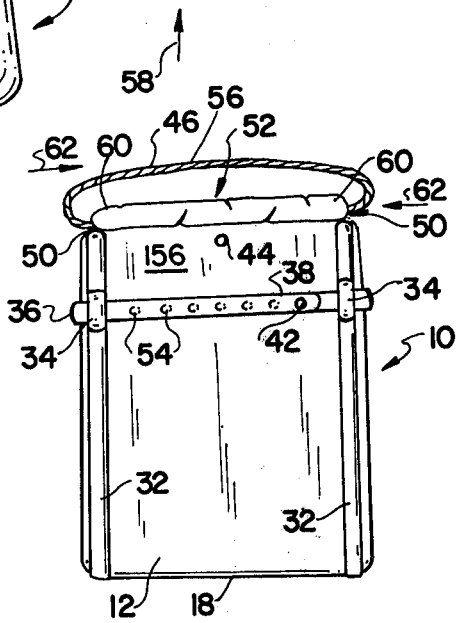
FIG. 2 is a front elevation view of the present invention shown in a semi-folded up mode.

FIG. 2 illustrates string attachment 46 shown emerging outwardly from openings 50 disposed at the ends of sheet 12, adjacent the open mouth portion 52, formed opposite the marginal edge 18 thereof. In this position, snap fastener component 42 is installed to the right of dotted lines 54, denoting unused complementary snap fasteners carried by strap 36, located behind end 38 of girth encircling strap 36. When string attachment 46 is pulled upwardly, at point 56, in the direction of arrow 58, ends 60, of the passageway in which string attachment 46 resides, move inwardly towards each other, in the direction of arrows 62. In this condition, open mouth portion 52 is collapsed, thereby permitting present invention 10 to carry small articles within the confines between sheet 12, and sheet 14, shown in FIG. 1.

Figure 3:
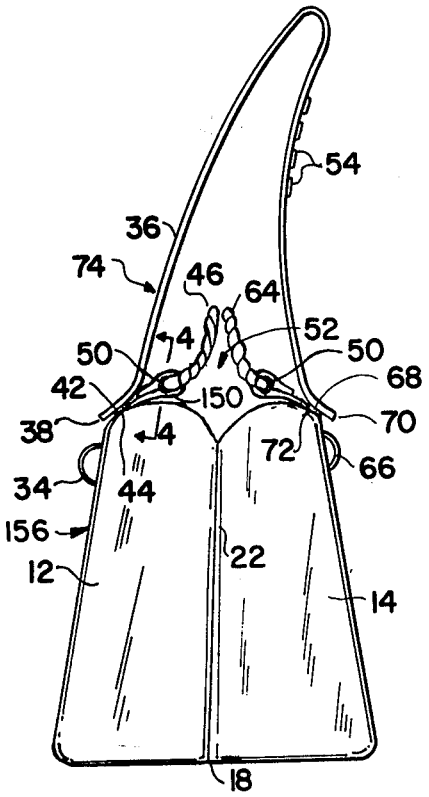
FIG. 3 is a side elevation view of the present invention shown in an expanded mode, having the waist encircling strap being utilized in the shoulder carrying mode thereof.

FIG. 3 illustrates string attachment 46 and its mated string attachment 64. Both string attachments emerge outwardly from openings 50 located in sheets 12 and 14, adjacent open mouth region 52, shown in a collapsed condition, due to disposing string attachments 46 and 64 in close engagement. Waist encircling strap 36 is shown removed from loops 34 and companion loops 66, carried on sheet 14. Marginal edge 22 is shown extending intermediate sheets 12 and 14 and is formed thereby. Such marginal edge is not shown tucked behind sheet 12, as in FIG. 2, but may extend outwardly from decorative binding 32, as shown in FIG. 1. Snap fastener 42, disposed at end 38 of girth encircling strap 36, is shown snappingly engaged with complementary snap fastener 44. Another snap fastener 68, is shown carried adjacent end 70, of girth encircling strap 36, and is secured to another complementary snap fastener 72, secured to sheet 14, in a similar position to complementary snap fastener 44. In this position, complementary snap fasteners 54 are shown disposed on an outermost surface 74 of girth encircling strap 36. In the position shown in FIG. 1, girth encircling strap 36 has snap fastener 68 disposed in touching engagement with an exterior surface of either sheet 12 or sheet 14 shown thereat. Another complimentary snap fastener, not shown, similar to complementary snap fastener 44, may be located on such surface, at a convenient location, facilitating the storage of end 70 on such surface, when girth encircling strap 36 is stored in a girth encircling position, as shown in either FIGS. 1 or 2.

Figure 4:
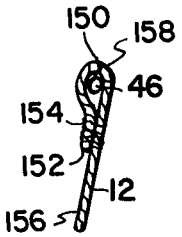
FIG. 4 is a side elevation, cross-sectional view, taken along lines 4—4, viewed in the direction of arrows 4—4, of the apparatus shown in FIG. 3.

FIG. 4 illustrates a cross-sectional view of a portion of the apparatus shown in FIG. 3, disposed defining passageway 150 in which string attachment 46 resides. It should be noted that holes 50, shown in FIGS. 2 and 3, define the ends of passageway 150. Free end 152, of sheet 12 is secured to external surface 156, of sheet 12, utilizing stitches 154 thereof. Bight 158 thus defines passageway 150. The same construction is utilized to form a passageway in which string attachment 64, shown in FIG. 3, resides.

One of the advantages of the present invention is a collapsible and expandable shopping bag which may be utilized to carry large or small packages with equal ease.

Another advantage of the present invention is an expandable shopping bag wherein the otherwise usable small gathering-like handle disposed in the marginal edges thereof, are not required for purposes of carrying the bag when large articles are disposed carried within the bag.

Still another advantage of the present invention is a girth encircling strap which permits the bag to be utilized in a collapsed or folded up condition whilst carrying articles, serving as a shoulder strap, if desired, when the bag or pouch is permitted to be expanded to full size whilst carrying larger articles.

Yet another advantage of the present invention is a shopping bag or pouch which may be carried about utilizing hand grasping handles and a shoulder strap carrying means.

A further advantage of the present invention is a girth encircling strap which may be utilized to secure articles within the bag when such strap is maintained in a tightened condition therearound.

Another advantage of the present invention is a pouch or bag expansion limiting strap which adds greater strength to the bag when installed wrapped around the girth of such bag.

Still another advantage of the present invention is a pouch-like shopping bag having a pair of opposed hand grasping handles serving to close the open mouth portion of the pouch when such handles are grasped and utilized to lift the bag upwardly.

Yet another advantage of the present invention is an expandable shopping bag having a storage location for shoulder straps, when such shoulder straps are not being utilized for the bag carrying operation.

Thus, there is disclosed in the above description and in the drawings, an embodiment of the invention which fully and effectively accomplishes the objects thereof. However, it will become apparent to those skilled in the art, how to make variations and modifications to the instant invention. Therefor, this invention is to be limited, not by the specific disclosure herein, but only by the appending claims.

The embodiment of the invention in which an exclusive privilege or property is claimed are defined as follows:

1. An expandable shopping bag comprising a flexible pouch, said pouch having an open mouth portion, the marginal edge of said pouch adjacent said open mouth portion having a pair of opposed passageways therein extending parallel to said marginal edge, each of said passageways having a flexible string-like band passing therethrough, a flexible strap, means to removably secure portions of said flexible strap to the exterior surface of said pouch wherein said flexible strap extends parallel to said open mouth portion, means to removably fasten one end of said flexible strap to selected portions of the length of said strap, means to removably fasten both ends of said flexible strap to said pouch such that said flexible strap extends athwart said open mouth portion.

2. The apparatus as claimed in claim 1 wherein said means to removably secure said flexible strap to said pouch comprises a plurality of loops, said plurality of loops secured to the external surface of said pouch.

3. The apparatus as claimed in claim 1 wherein said means to removably fasten one end of said flexible strap comprises a snap fastener component secured to said one end of said strap, a plurality of complementary shaped snap fastener components, said plurality of complementary shaped snap fastener components being secured to said flexible strap intermediate the ends thereof.

4. The apparatus as claimed in claim 1 wherein said means to removably fasten both ends of said flexible strap to said pouch comprises a pair of complementary shaped snap fasteners, said pair of complementary shaped snap fasteners being secured to the exterior surface of said pouch adjacent said open mouth portion thereof, another snap fastener component, said another snap fastener component being secured to the other end of said flexible strap.

5. The apparatus as claimed in claim 1 wherein said pouch further comprises a pair of sheets, said pair of sheets being secured together on opposed marginal edges thereof and along another marginal edge thereof extending transverse said opposed marginal edges.

6. The apparatus as claimed in claim 5 wherein said pouch is canvas.

7. The apparatus as claimed in claim 1 wherein said flexible strap is leather.

8. The apparatus as claimed in claim 1 further comprising a pair of bindings, said pair of bindings extending transverse to said open mouth portion and fixedly secured to said pouch.

* * * * *